US005566663A

United States Patent [19]

Hamburg et al.

[11] Patent Number: 5,566,663

[45] Date of Patent: Oct. 22, 1996

[54] AIR/FUEL CONTROL SYSTEM WITH IMPROVED TRANSIENT RESPONSE

[75] Inventors: Douglas R. Hamburg, Bloomfield Hills; Nicholas G. Zorka, Clarkston, both of Mich.

[73] Assignee: Ford Motor Company, Dearborn, Mich.

[21] Appl. No.: 297,085

[22] Filed: Oct. 17, 1994

[51] Int. Cl.[6] ..... F02D 41/00

[52] U.S. Cl. ..... 123/679

[58] Field of Search ..... 123/679, 672, 123/434, 675, 481, 674

[56] References Cited

U.S. PATENT DOCUMENTS

| | | | |
|---|---|---|---|
| 4,355,618 | 10/1982 | Muller et al. | 123/679 |
| 4,375,797 | 3/1983 | Otsuka et al. | 123/679 |
| 5,115,781 | 5/1992 | Kurita et al. | 123/481 |
| 5,241,943 | 9/1993 | Miyashita et al. | 123/679 |
| 5,253,630 | 10/1993 | Akazaki et al. | 123/679 |
| 5,381,774 | 1/1995 | Nakajima | 123/674 |

OTHER PUBLICATIONS

SAE Technical Paper Series 910390, entitled "Fuel Injection Control Systems That Improve Three Way Catalyst Conversion Efficiency", by Katashiba et al, dated Feb. 25–Mar. 1, 1991, pp. 1–9.

*Primary Examiner*—Raymond A. Nelli
*Attorney, Agent, or Firm*—Allan J. Lippa

[57] ABSTRACT

An engine air/fuel control system and method is provided having feedback control responsive to an exhaust gas oxygen sensor. A fuel command responsive to the EGO sensor is modulated (312) and the modulation disabled in response to detection of an air/fuel transient period (502–510, 610). In addition, feedback control gain is increased (514, 614) and the modulation signal held at a value opposite the state of the EGO sensor occurring upon initiation of the air/fuel transient period (510, 610). An indication is provided that the air/fuel transient is terminated when the EGO sensor switching frequency resumes a normal condition (522–528, 622–628). Modulation is thereafter resumed and the feedback gain restored (532–538, 632–638).

15 Claims, 5 Drawing Sheets

AIR/FUEL CONTROL SYSTEM WITH IMPROVED TRANSIENT RESPONSE

BACKGROUND OF THE INVENTION

The field of the invention relates to air/fuel control systems for internal combustion engines.

It is known to adjust a mixture of air and fuel inducted into an engine in response to a feedback variable derived by integrating an output of a two-state exhaust gas oxygen sensor. In such systems, the inducted air/fuel mixture oscillates about a stoichiometric air/fuel ratio. It is also known to modulate the fuel inducted into the engine by a periodic modulation signal to synchronize the aforementioned oscillations.

The inventors have recognized a number of problems with the above approaches. One problem is that an air/fuel transient caused, for example, by accelerator pedal tip-in may cause an air/fuel transient. And such a transient may be exacerbated by the aforesaid modulation signal.

SUMMARY OF THE INVENTION

An object of the invention claimed herein is to provide an air/fuel feedback control system with fuel modulation which reduces, rather than enhances, air/fuel transients.

The above object is achieved, problems of prior approaches overcome, and advantages obtained, by providing both a method and a system to control an engine's air/fuel ratio. In one particular aspect of the invention, the method comprises the steps of: generating a fuel command for providing fuel to the engine in response to an output signal from an exhaust gas oxygen sensor; modulating the fuel command with a modulation signal; generating a detected air/fuel transient period in response to the output signal; and altering the modulation signal during the detected air/fuel transient period.

Preferably, the modulation signal is held at an amplitude providing a lean bias to the fuel command when the output signal was at a rich value upon commencement of the detected air/fuel transient period. And, preferably, the modulation signal is held at an amplitude providing a rich bias to the fuel command when the output signal was at a lean value upon commencement of the detected air/fuel transient period.

An advantage of the above aspect of the invention is that the modulation signal is altered to prevent enhancement of an air/fuel transient. A further advantage is that the modulation signal is altered to reduce, rather than enhance, an air/fuel transient.

In another aspect of the invention, the fuel command is responsive to a feedback variable derived from the exhaust gas oxygen sensor output signal. And the feedback variable is multiplied by a gain value during the modulation altering step. An advantage of this aspect of the invention is to reduce any air/fuel transient.

In another aspect of the invention, an air/fuel control system comprises: an exhaust gas oxygen sensor coupled to an engine exhaust manifold having an output signal with a first state and a second state respectively corresponding to exhaust gases being rich or lean of stoichiometry; a fuel controller generating a fuel command for delivering fuel to the engine in response to a feedback variable derived by integrating the output signal, the fuel controller modulating the delivered fuel with a periodic modulation signal; and an air/fuel controller generating a detected air/fuel transient period in response to the output signal and altering the modulation signal during the detected air/fuel transient period.

An advantage of the above aspect of the invention is that any air/fuel transient is reduced by control of the modulation signal.

DESCRIPTION OF THE DRAWINGS

The above object and advantages are achieved, and disadvantages of prior approaches are overcome, by the following exemplary description of a control method and system which embodies the invention with reference to the following drawings wherein.

DESCRIPTION OF THE PREFERRED EMBODIMENT

Figure 1:
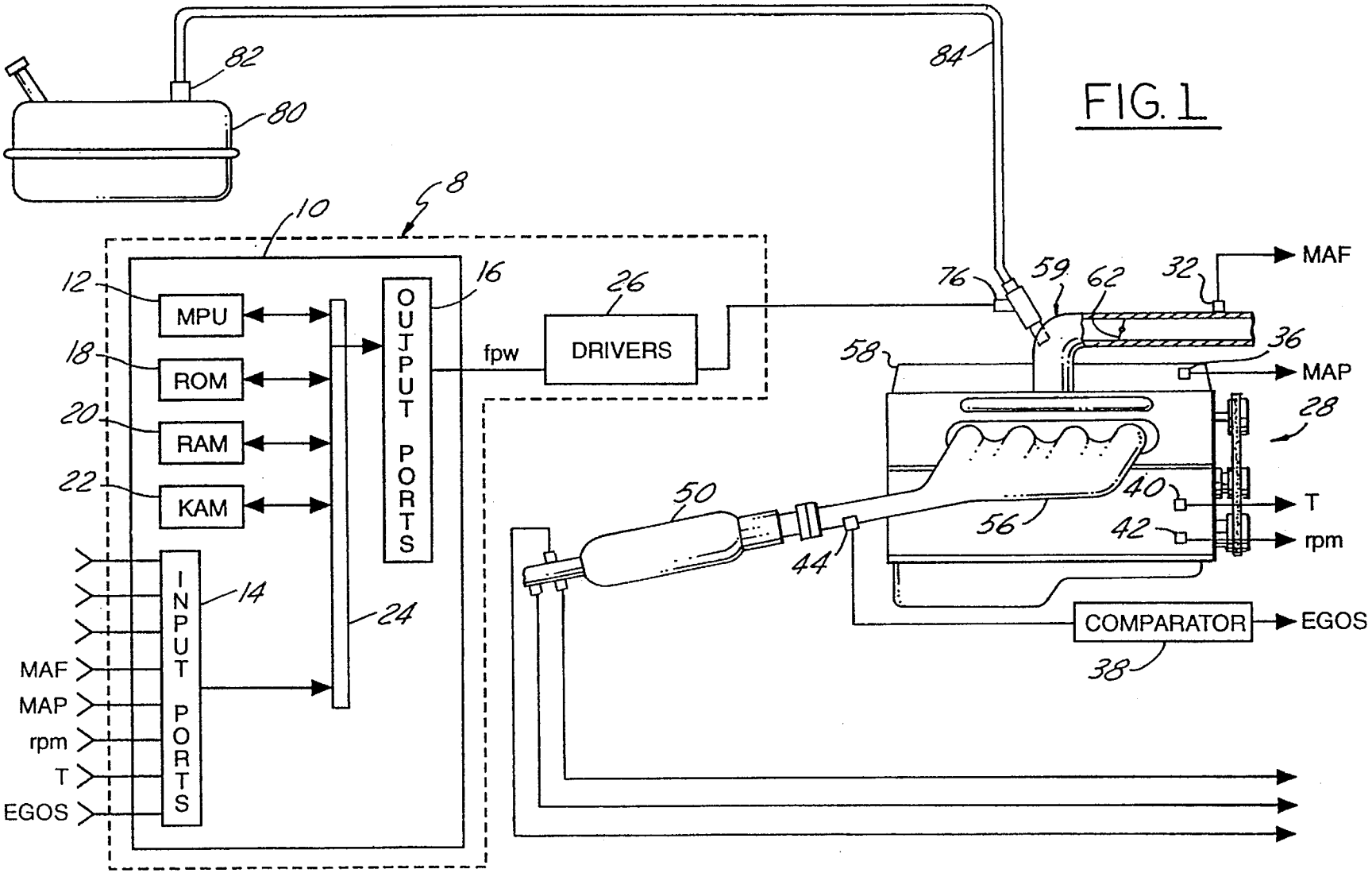
FIG. 1 is a block diagram of an engine and control system in which the engine is used to advantage.

Controller 8 is shown in the block diagram of FIG. 1 as a conventional engine controller having microcomputer 10 which includes: microprocessor unit 12; input ports 14; output ports 16; read-only memory 18, for storing the control program; random access memory 20 for temporary data storage which may also be used for counters or timers; keep-alive memory 22, for storing learned values; and conventional data bus 24. Controller 8 also includes electronic drivers 26 and other conventional engine controls well-known to those skilled in the art such as exhaust gas recirculation control and ignition control.

Various signals from sensors coupled to engine 28 are shown received by controller 8 including; measurement of inducted mass airflow (MAF) from mass airflow sensor 32; manifold pressure (MAP), commonly used as an indication of engine load, from pressure sensor 36; engine coolant temperature (T) from temperature sensor 40; and indication of engine speed (rpm) from tachometer 42.

Controller 8 receives two-state (rich/lean) signal EGOS from comparator 38 resulting from a comparison of a reference value to exhaust gas oxygen sensor 44. In this example, exhaust gas oxygen sensor 44 is coupled to exhaust manifold 56 upstream of catalytic converter 50. And, in this example, signal EGOS is a positive predetermined voltage such as one volt when the output of exhaust gas oxygen sensor 44 is greater than the reference value and a predetermined negative voltage when the output of sensor 44 switches to a value less than the reference value. Under ideal conditions, with an ideal sensor and exhaust gases fully equilibrated, signal EGOS will switch states at a value corresponding to stoichiometric combustion. Those skilled in the art will recognize that other sensors may be used to advantage such as proportional exhaust gas oxygen sensors.

Intake manifold 58 of engine 28 is shown coupled to throttle body 59 having primary throttle plate 62 positioned therein. Throttle body 59 is also shown having fuel injector 76 coupled thereto for delivering liquid fuel in proportion to the pulse width of signal fpw from controller 10. Fuel is delivered to fuel injector 76 by a conventional fuel system including fuel tank 80, fuel pump 82, and fuel rail 84.

Although a fuel injected engine is shown in this particular example, the invention claimed later herein may be practiced with other engines such as carbureted engines. It will also be recognized that conventional engine systems are not shown for clarity such as an ignition system (typically including a coil, distributor, and spark plugs), an exhaust gas recirculation system, fuel vapor recovery system and so on.

Figure 2:
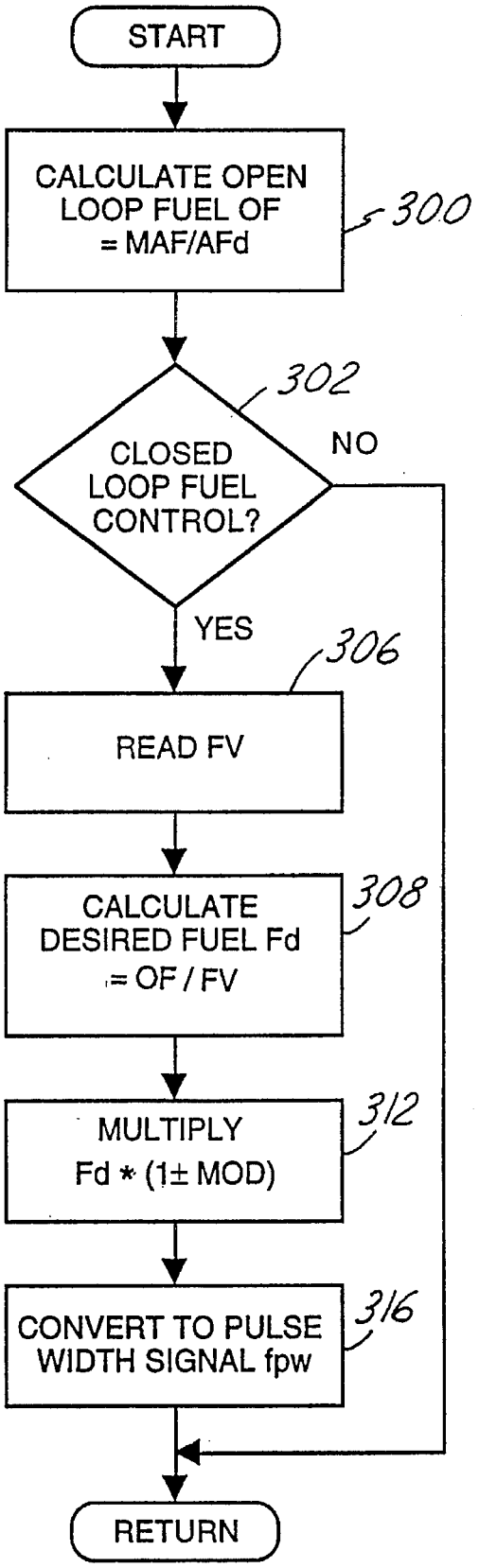
FIGS. 2–3 are flowcharts of a subroutine executed by a portion of the embodiment shown in FIG. 1.

The liquid fuel delivery routine executed by controller 8 for controlling engine 28 is now described beginning with reference to the flowchart shown in FIG. 2. An open loop calculation of desired liquid fuel (signal OF) is calculated in step 300. More specifically, the measurement of inducted mass airflow (MAF) from sensor 32 is divided by a desired air/fuel ratio (AFd) which, in this example, is correlated with stoichiometric combustion. A determination is made that closed loop or feedback control is desired (step 302), by monitoring engine operating parameters such as temperature T. Desired fuel quantity, or fuel command, for delivering fuel to engine 28 is generated by dividing feedback variable FV into the previously generated open loop calculation of desired fuel (signal OF) as shown in step 308. Fuel command or desired fuel signal Fd is then modulated by modulation signal MOD as shown in step 312. The modulated fuel command is then converted to pulse width signal fpw (step 316) for actuating fuel injector 76.

Figure 3:
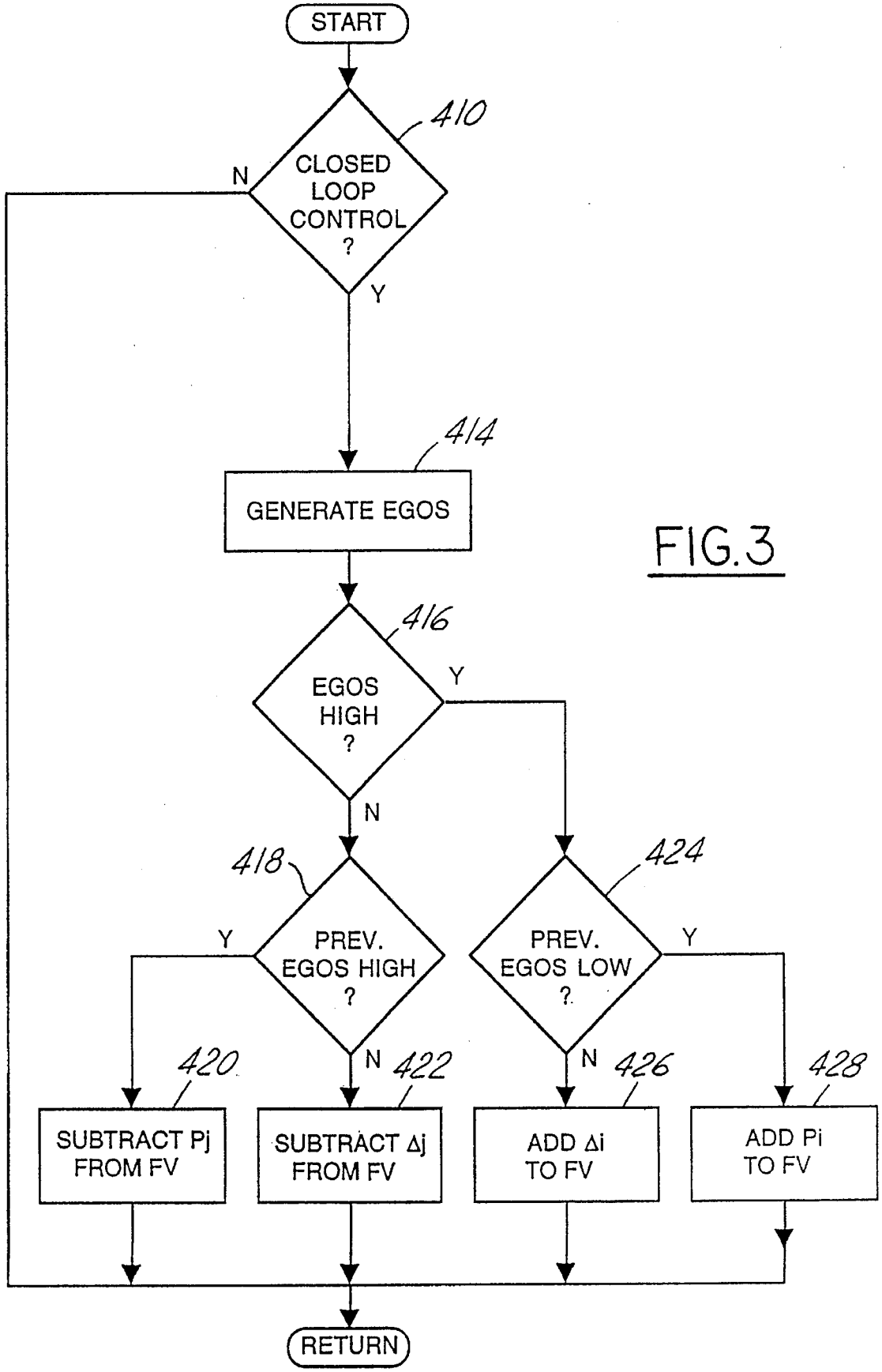

The air/fuel feedback routine executed by controller 8 to generate fuel feedback variable FV is now described with reference to the flowchart shown in FIG. 3. Signal EGOS is read, after determining that closed loop air/fuel control is desired in step 410. When signal EGOS is low (step 416), but was high during the previous background loop of microcontroller 8 (step 418), preselected proportional term Pj is subtracted from feedback variable FV (step 420). When signal EGOS is low (step 416), and was also low during the previous background loop (step 418), preselected integral term Δj, multiplied by gain value G1, is subtracted from feedback variable FV (step 422). Gain value G1 is provided as described later herein with particular reference to FIGS. 4A–4B to reduce any air/fuel transient.

Similarly, when signal EGOS is high (step 416), and was also high during the previous background loop of controller 8 (step 424), integral term Δj, multiplied by gain value G1, is added to feedback variable FV (step 426). When signal EGOS is high (step 416), but was low during the previous background loop (step 424), proportional term Pi is added to feedback variable FV (step 428).

Figure 4A:
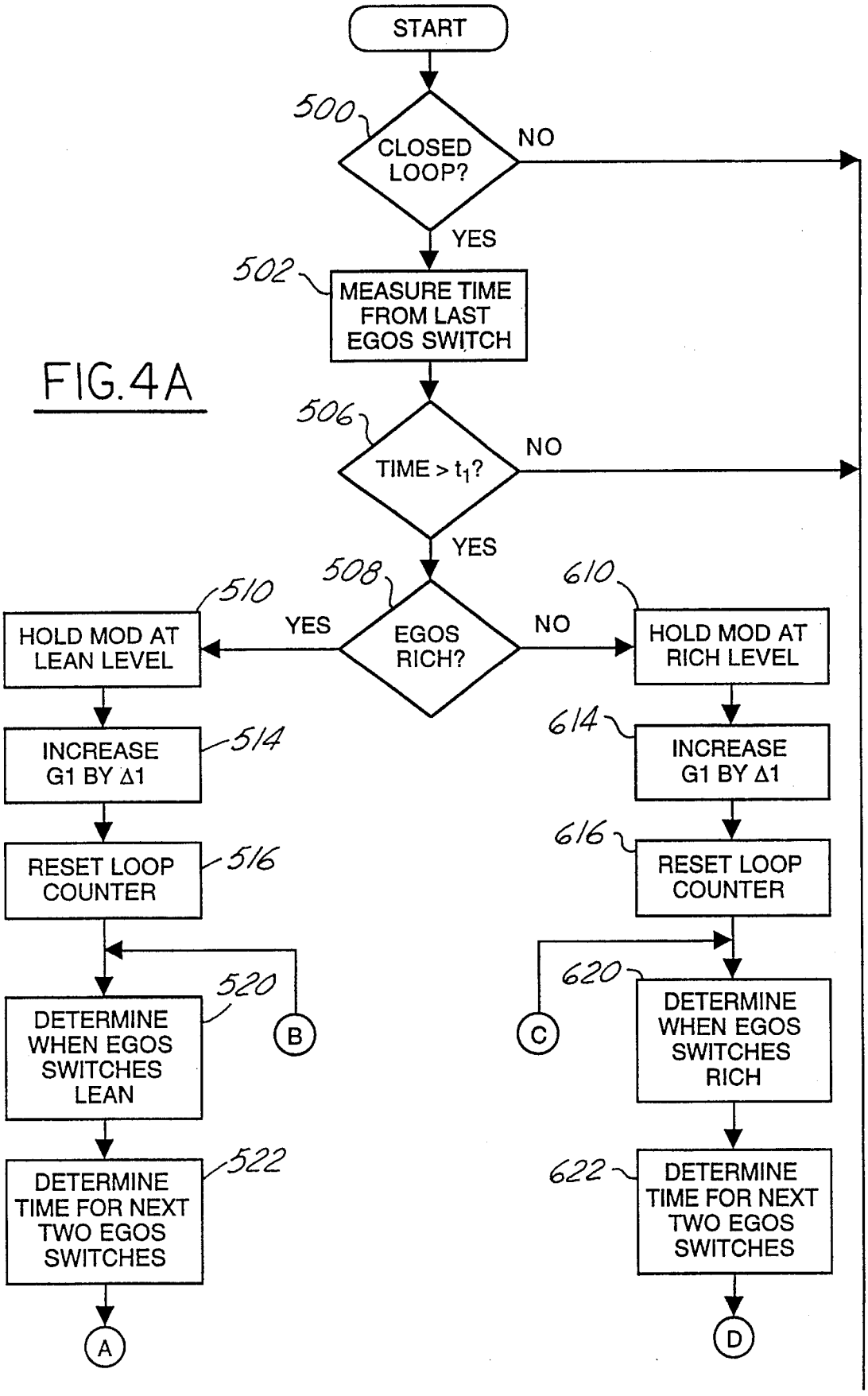
FIGS. 4A–4B are flowcharts of another subroutine executed by a portion of the embodiment shown in FIG. 1.
Figure 4B:
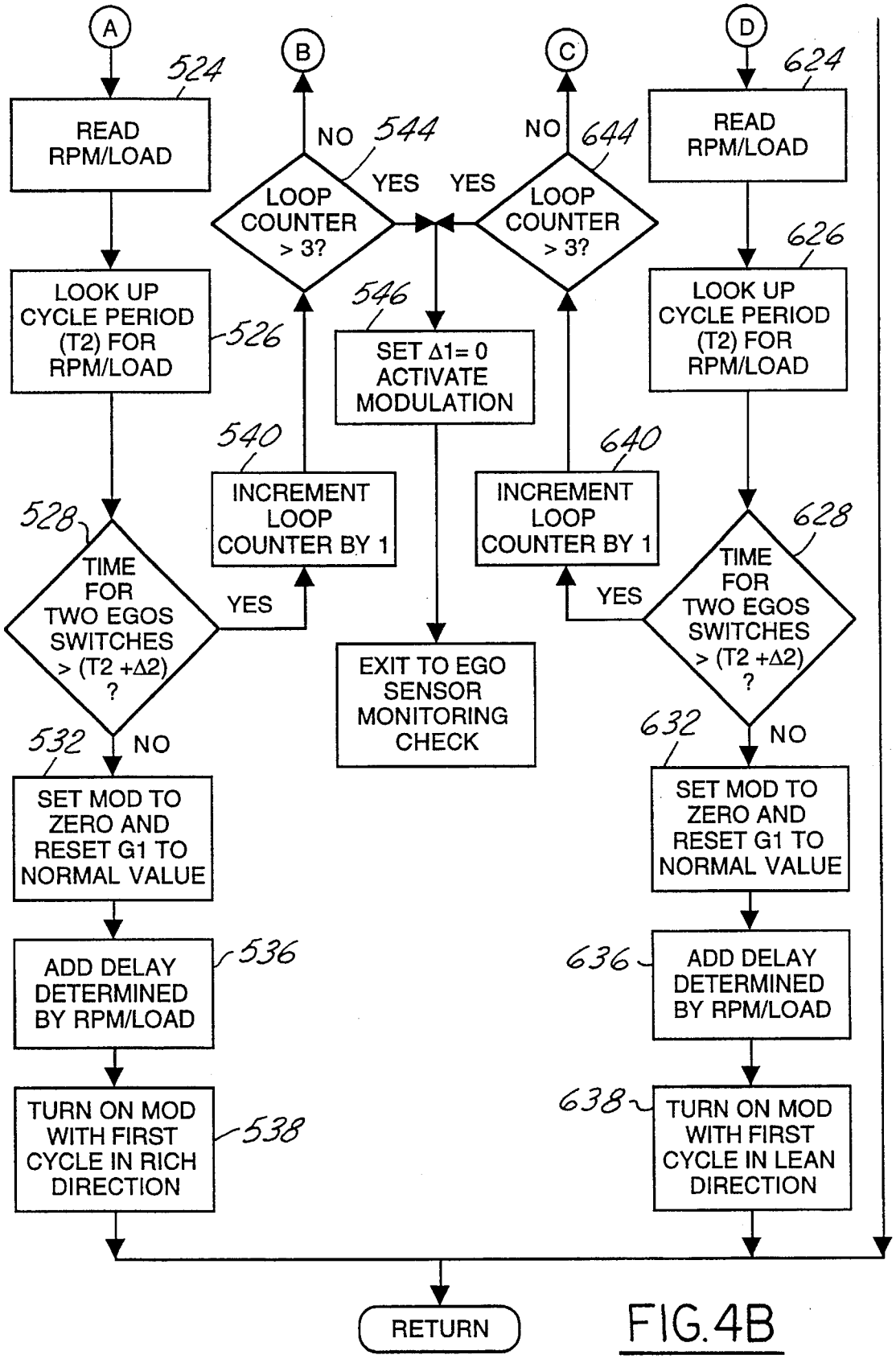

An air/fuel modulation control routine is now described with reference to the subroutine shown in FIGS. 4A–4B. After closed loop air/fuel feedback control is determined (step 500), the time since last change in state of signal EGOS is determined in step 502. If this time is greater than predetermined time $t_1$ (step 506), the previous state of signal EGOS is sampled during step 508. If the previous state of signal EGOS was rich, then the subroutine continues with steps 510–538. However, if the previous state of signal EGOS was lean, then the routine continues with steps 610–638. It is recognized by those skilled in the art that steps 610–638 are substantially the same as corresponding steps 510–538 wherein like numbers refer to like steps. Because the two routines are substantially the same, it is only necessary to describe the routine with respect to steps 510–538.

Continuing on with steps 510–538, modulation signal MOD is held at an output state opposite that of signal EGOS at time $t_1$. In this particular example, signal MOD is held at its lean output state (step 510).

Gain value G1 is increased by predetermined amount Δ1 as shown in step 514 to increase the responsiveness of feedback air/fuel control to correct for the air/fuel transient detected in step 506. Similarly, holding modulation signal MOD at a level opposite of the previous state of signal EGOS also decreases the detected air/fuel transient.

For reasons described later herein, a loop counter is reset during step 516. After signal EGOS switches back to its lean output state (520), the time required for the next two switches of signal EGOS is determined in step 522. Essentially, a determination is thereby made of the switching frequency of signal EGOS for future determination of whether the air/fuel transient has ended. To accomplish such determination, engine speed and load are read during step 524 and a desired or normal cycle period for signal EGOS read from memory during step 526 for the particular rpm and load of engine 28.

If the time period for the last two EGOS switches is less than the cycle period looked up in step 526 plus an additional time Δ2, then the transient period has ended (see step 528), and modulation signal MOD is deactivated. In this example, modulation signal MOD is set to zero. Further, gain value G1 is returned to a normal value (step 532). After a delay time determined by engine speed and load (step 536), modulation signal MOD is reactivated during step 538. In this particular example, modulation signal MOD is reactivated in its rich direction.

On the other hand, if the time period for the last two EGO switches is less than the cycle period plus time Δ2, the detected air/fuel transient has not ended (step 528). The loop counter is then incremented (step 540).

If the loop counter exceeds three (step 544), gain value G1 is returned to its normal value (that is value Δ1 is set to zero) during step 546. Thereafter, this subroutine is exited and an EGO sensor monitoring check commenced (step 548).

While preferred embodiments of the invention have been shown and described herein, it will be understood that such embodiments are provided by way of example only. Numerous variations, changes, and substitutions will occur to those skilled in the art without departing from the spirit of the invention. For example, the time period or number of transitions in output state of the EGO sensor may be varied to determine the beginning and end of an air/fuel transient period. Further, other forms of modulation may be shown in addition to the one described in this particular example. The invention claimed later herein is equally applicable to modulation schemes wherein the feedback variable, for example, is modulated. Accordingly, it is intended that the appended claims cover all such variations as fall within the spirit and scope of the invention.

What is claimed is:

1. A method for controlling engine air/fuel ratio, comprising the steps of:

delivering fuel to the engine in response to a fuel command signal from a controller having a microprocessor;

generating said fuel command signal by said controller in response to an output signal from an exhaust gas oxygen sensor;

modulating said fuel command signal by said controller with a modulation signal;

generating a detected air/fuel transient period by said controller in response to said output signal; and altering said modulation signal by said controller during said detected air/fuel transient period.

2. The method recited in claim 1 wherein said detected air/fuel transient period is initiated in response to said output signal remaining in substantially one output state for a predetermined time.

3. The method recited in claim 1 wherein said detected air/fuel transient period ends in response to changes in output state of said output signal.

4. The method recited in claim 3 wherein said detected air/fuel transient period ends when said output signal transitions between state changes at a frequency greater than a preselected frequency.

5. The method recited in claim 4 wherein said preselected frequency is determined as a function of engine speed and load.

6. The method recited in claim 1 wherein said step of altering said modulation signal in response to said detected air/fuel transient period further comprises a step of holding said modulation signal at an amplitude providing a lean bias to said fuel command when said output signal was at a rich value upon generation of said detected air/fuel transient period.

7. The method recited in claim 1 wherein said step of altering said modulation signal in response to said detected air/fuel transient period further comprises a step of holding said modulation signal at an amplitude providing a rich bias to said fuel command when said exhaust signal was at a lean value when said detected air/fuel transient period commenced.

8. The method recited in claim 1 further comprising a step of removing said modulation for a preselected time after said detection air/fuel transient period ends.

9. The method recited in claim 1 wherein said fuel command is responsive to a feedback variable derived from said output signal.

10. The method recited in claim 9 further comprising a step of modifying said feedback variable with a gain value during said modulation altering step.

11. The method recited in claim 1 further comprising a step of generating said output signal from said exhaust gas oxygen sensor with two output states consisting of a rich output state and a lean output state when said exhaust gas oxygen sensor indicates exhaust gases are respectively rich or lean of a predetermined air/fuel ratio.

12. The method recited in claim 1 wherein said step of generating said fuel command further comprises a step of dividing a measurement of airflow inducted into the engine by a desired air/fuel ratio.

13. An air/fuel control system for an engine, comprising:

an exhaust gas oxygen sensor coupled to an engine exhaust manifold having an output signal with a first state and a second state corresponding to exhaust gases being respectively rich or lean of stoichiometry;

a fuel controller generating a fuel command in response to a feedback variable derived by integrating said output signal, said fuel controller modulating said delivered fuel with a periodic modulation signal;

a fuel system providing a flow of fuel to the engine in response to said fuel command; and an air/fuel controller generating a detected air/fuel transient period in response to said output signal and altering said modulation signal during said detected air/fuel transient period.

14. The system recited in claim 13 wherein said air/fuel controller initiates said detected air/fuel transient period in response to an absence in change of output state of said output signal for a predetermined time.

15. The system recited in claim 13 wherein said air/fuel controller terminates said detected air/fuel transient period in response to detection of changes in output state of said output signal.

* * * * *